United States Patent [19]

Shaubach et al.

[11] 4,451,210

[45] May 29, 1984

[54] DIAPHRAGM VAPOR PUMP

[75] Inventors: Robert M. Shaubach, Lititz; George Y. Eastman, Lancaster; Vincent P. Roehm, Landisville, all of Pa.

[73] Assignee: Thermacore, Inc., Lancaster, Pa.

[21] Appl. No.: 378,402

[22] Filed: May 14, 1982

[51] Int. Cl.[3] ..... F04B 19/24

[52] U.S. Cl. ..... 417/52; 417/209

[58] Field of Search ..... 417/207, 208, 209, 52, 417/379, 395

[56] References Cited

U.S. PATENT DOCUMENTS

| | | | |
|---|---|---|---|
| 84,912 | 12/1868 | Sharr | 417/395 |
| 776,106 | 11/1904 | Beurrier | 417/149 |
| 862,867 | 8/1907 | Eggleston | 417/390 |
| 1,900,656 | 3/1933 | Munters | 417/208 |
| 2,015,240 | 9/1935 | Scott-Snell et al. | 417/208 |
| 2,039,999 | 5/1936 | Holyfield | 417/379 |
| 2,089,853 | 8/1937 | Nelson | 417/395 |
| 2,389,067 | 11/1945 | Lieberman | 417/379 |
| 2,578,992 | 12/1951 | Dickey | 417/379 |
| 2,755,745 | 7/1956 | Lewis | 417/379 |
| 3,062,002 | 11/1962 | Shaffer | 417/379 |
| 3,149,754 | 9/1964 | Kogan et al. | 417/395 |
| 3,309,012 | 3/1967 | Booth et al. | 417/395 |
| 3,331,616 | 7/1967 | Jackson | 417/379 |
| 3,680,981 | 8/1972 | Wagner | 417/395 |
| 3,937,599 | 2/1976 | Thureau et al. | 417/379 |
| 4,177,020 | 12/1979 | Chadwick | 417/395 |
| 4,197,060 | 4/1980 | Chadwick | 417/379 |
| 4,265,600 | 5/1981 | Mandroian | 417/379 |

FOREIGN PATENT DOCUMENTS

| | | | |
|---|---|---|---|
| 672385 | 7/1979 | U.S.S.R. | 417/52 |

*Primary Examiner*—Edward K. Look

*Attorney, Agent, or Firm*—Martin Fruitman

[57] ABSTRACT

A diaphragm pump for liquids operating by heating and vaporizing a part of the pumped liquid on the motive side of the diaphragm. A center spindle upon which the diaphragm slides is shaped to permit a limited amount of liquid to leak through into the vapor side while also permitting a release of pressure at the top end of the stroke. The spindle is also shaped to permit a suitable pressure buildup during the midportion of the stroke.

12 Claims, 3 Drawing Figures

DIAPHRAGM VAPOR PUMP

SUMMARY OF THE INVENTION

This invention deals generally with pumps and more specifically with a diaphragm pump.

Although vapor diaphragm pumps are well known in the art, such pumps are typically constructed with two separate fluid systems to permit the use of one highly volatile fluid to pump another which has different thermal characteristics. Such systems, first of all, require two different fluids, and as a result, require a system of isolating the fluids to prevent mixing. Moreover, any such vapor diaphragm pump also requires a means of condensing the volatile or pumping fluid in order to recycle the pump. This latter requirement has generally been solved by one of several approaches none of which has been completely satisfactory.

The simplest system has involved simple removal of the heat which vaporizes the fluid. However, while this has been possible in some limited applications such as single stroke pumps cycling with removal of sunlight, it is completely impractical in more common applications such as hot water circulation for building heating. Another type pump recycles itself by exhausting the vapor to the atmosphere, but, like a classic piston steam engine this requires constant replenishment of the pumping liquid. Finally, there are those systems which, by adding considerable complexity to the apparatus, use separate condensers and valves to recycle the spent vapor for reuse. All of these systems suffer from either unsatisfactory operation due to dependence upon the removal of heat or vapor from the system, or complexity of construction and operation due to the apparatus to recycle the vapor.

The present invention overcomes these problems by using the same fluid as both the pumping and the pumped fluid, and rather than isolating the two fluid systems, it uses the mixing of the vapor with the pumped fluid to both condense the vapor and to utilize the waste heat. This is essentially accomplished by using the very device that the prior art has so steadfastly avoided, a leaking diaphragm, but by controlling the leak to permit the interchange of fluids in one direction or the other only at the appropriate time in the pumping cycle.

The present invention is constructed with a chamber partitioned into two sections by a flexible diaphragm which is designed to move between the sections, enlarging one volume as it shrinks the other. Depending upon the construction and material of the diaphragm, it may be spring loaded, but a predictable rest position to which the diaphragm returns when not acted upon by external forces is a requirement for operation.

The pumped or liquid section of the device requires two openings, one a liquid input and the other a liquid exit. A check valve or other unidirectional determining means is required in conjunction with at least one of the openings to determine the direction of fluid flow and prevent simply oscillating the liquid in both openings.

The pumping or vapor section is completely enclosed, having no fluid entrance or exit except for a specially constructed opening in the diaphragm. This opening connects the vapor section with the pumped section and is designed to vary for the various portions of the pumping cycle. The opening is constructed by building a simple hole into the diaphragm and, in its preferred embodiments, passing through the hole a spindle which regulates the leakage.

The diaphragm therefore moves along the axis of the spindle as it moves back and forth varying the volume of the vapor and pumped sections of the pump. Variations built into the cross section of the spindle, acting in conjunction with the fixed cross section of the hole, therefore vary the effective cross section of the orifice, and are used to control the pump action.

For instance, while the vapor pressure buildup on the vapor side is moving the diaphragm to reduce the volume of the pumped side, the orifice is highly restricted to develop the pressure, but at the end of the stroke, when the vapor energy is spent, the orifice is opened up to facilitate venting the vapor.

The spindle is also reduced in cross section at its end well within the vapor section. This permits the liquid to enter the vapor section for vaporization and powering another stroke of the pump.

In the version without a spindle the pump operates with a fixed orifice and the flow direction is regulated only by the vapor pressure generated in the vapor section, and the release of pressure when the vapor pressure surpasses the liquid head.

Virtually any heat source generating temperatures high enough to vaporize the liquid can be used to drive the pump. The heat is applied to the vapor section, generally on the surface opposite from the diaphragm, and the heat utilization is particularly efficient when used in conjunction with a hot water system, since the heat of vaporization is eventually reclaimed in the pumped liquid as the vapor mixes with and is condensed into it.

The present invention is also relatively maintenance free since the reciprocating action of the diaphragm hole riding on the spindle tends to mechanically clean any deposits and foreign matter from the opening.

The invention is an efficient, maintenance free pump of simple construction which needs only a single small source of heat, such as a gas burner or solar heat, to furnish motive power. Its small size and simplicity makes it particularly desirable for use in conjunction with a hot water heating system in which the heat source is already available.

DETAILED DESCRIPTION OF THE INVENTION

Figure 1:
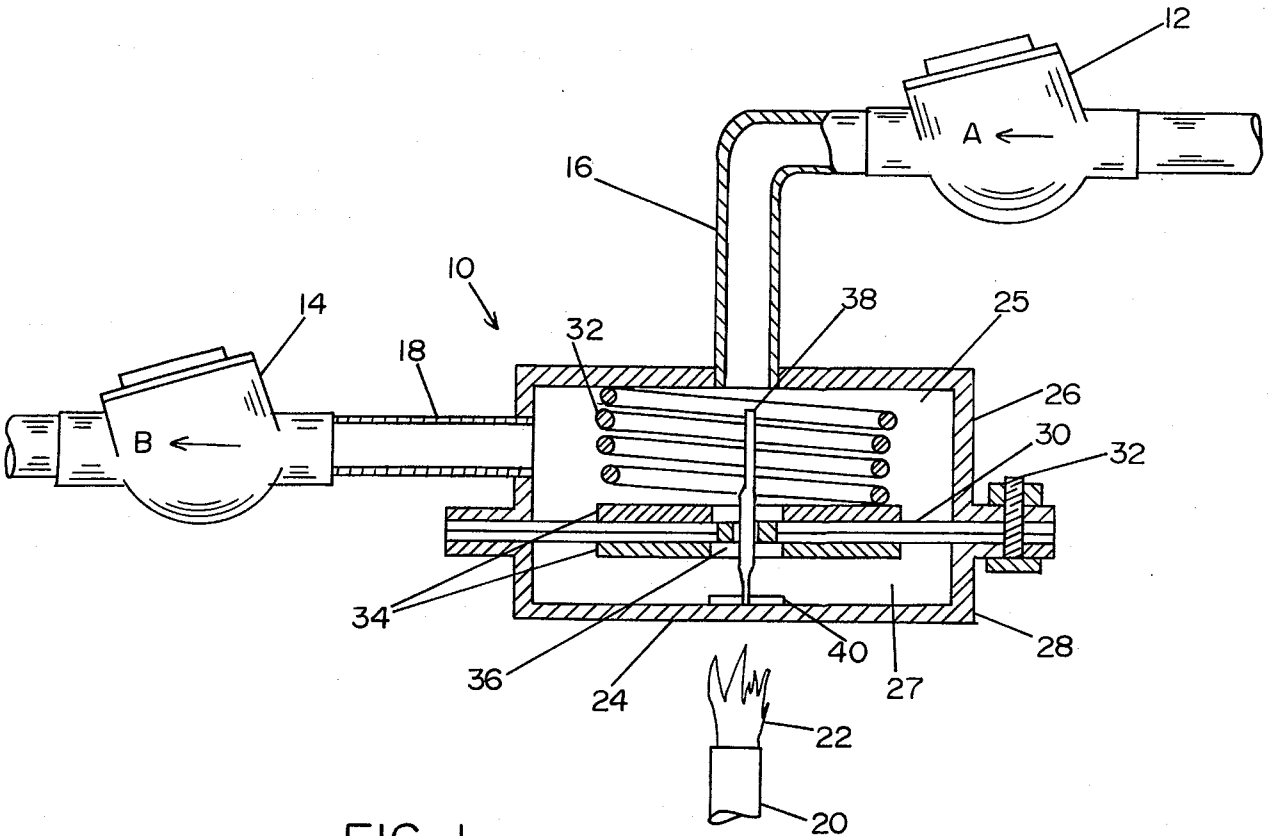
FIG. 1 is a cross section view of the preferred embodiment of the invention.

FIG. 1 is a cross section view of the preferred embodiment of diaphragm pump 10 connected between check valves 12 and 14 by pipes 16 and 18 so that liquid flow is permitted only in direction A by valves 12 and 14. Burner 20 producing flame 22 is representative of any heat source which could be applied to wall 24 of the outer casing of diaphragm pump 10. For simplicity of construction, pump 10 is constructed of two half shells 26 and 28 which clamp diaphragm 30 between them and are held together by nut and bolt pairs 32.

Diaphragm 30 is constructed to be flexible by conventional construction techniques such as the use of inherently flexible materials or multiple thin layers of material, and spring 32 is positioned and compressed to resist diaphragm movement away from wall 24. Spring 32 can, however, be omitted if diaphragm 30 itself has sufficient resiliency or the system has sufficient liquid pressure head to resist such movement. Similarly, support plates 34 may or may not be required, depending upon the characteristics of diaphragm 30.

Diaphragm 30 is constructed with an opening formed by orifice 36, and passing through orifice 36 is spindle 38 which is rigidly attached to the casing of pump 10 by means of attachment plate 40.

Figure 2:
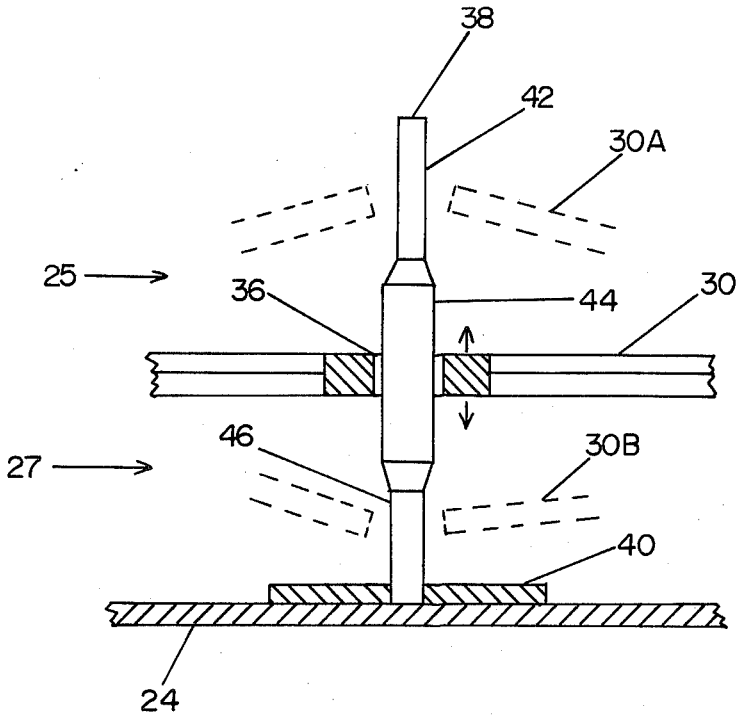
FIG. 2 is a cross section view of the detail of the spindle region of the preferred embodiment.

As shown in FIG. 2 spindle 38 contains three distinct sections 42,44 and 46 of different cross section. Section 44, the power stroke section, has the largest cross section. Its size is close to that of orifice 36 with essentially only enough clearance to permit relatively free sliding of orifice 36 upon section 44. Orifice 36 and spindle section 44 should be as tight as practical, considering expansion upon heating, to permit the sliding movement, but to minimize the leakage of vapor through the clearance area.

Section 42, the vapor venting section of spindle 38, has a considerably smaller cross section than does orifice 36 to permit free venting of vapor at the end of the diaphragm stroke. In one embodiment of the invention using water as a liquid, section 42 has a diameter of 0.050 inch when orifice 38 has a diameter of 0.086 inch. In that same embodiment section 46, the liquid fill section, has a diameter of 0.071 inch. The diameters of both sections 42 and 46 relative to the diameter of orifice 36 affect the pump operation significantly and these dimensions must essentially be "tuned" for the individual conditions of liquid, heat input, and resiliency of the diaphragm.

OPERATION OF THE PREFERRED EMBODIMENT

The operation of the invention can best be understood by reference to FIG. 1 and assuming that heat has just been applied to wall 24. Prior to heat application liquid flowing through check valve 12 in direction A has filled chamber 25, the pumped side of pump 10, but also, due to leakage through orifice 36, even if orifice 36 is adjacent to spindle section 44, some liquid has entered chamber 27, the vapor chamber, of pump 10. The start up of pump 10 does not, however, vary significantly even if vapor chamber 27 is completely full of liquid, which is the more likely situation since the liquid head is likely to move diaphragm 30 downward to section 46 where liquid leaks through easily.

As burner 20 is ignited and flame 22 heats wall 24, the heat transfers to liquid adjacent to wall 23 and vapor is generated within vapor chamber 27. As the heat continues to be applied the vapor pressure builds up in chamber 27, and as it surpasses the liquid head, the force of spring 32 and the resilient force of the diaphragm, diaphragm 30 begins to move, since the minimum clearance between spindle section 44 (FIG. 2) and orifice 36 permits no significant venting of the vapor. As diaphragm 30 reduces the volume of liquid chamber 25, liquid is forced out through check valve 14 in direction B since check valve 12 prevents flow opposed to direction A.

When the movement of diaphragm 30 moves orifice 36 into a position adjacent to spindle section 42, as shown by phantom lines 30A in FIG. 2, the area of orifice 36 available for venting increases significantly and the vapor in chamber 27 vents into and mixes with the liquid in chamber 25. This reduces the vapor pressure in chamber 27 and the combination of the liquid head, spring 32 and resilient force of diaphragm 30 reverse the diaphragm movement.

As diaphragm 30 moves back across spindle section 44, the combination of continuing venting, liquid leakage which causes condensation, and momentum cause diaphragm 30 to continue moving until it reaches position 30B (FIG. 2) at which point liquid enters vapor chamber 25 through the enlarged effective area of orifice 36. Increasing vapor pressure and resiliency of diaphragm 30 causes it to then return to its neutral position opposite spindle section 44 and the cycle repeats.

As diaphragm 30 moves to expand chamber 25, check valve 12 causes liquid to flow into chamber 25 in direction A while check valve 14 prevents flow opposed to direction B. The combined action of check valves 12 and 14 and pump 10, therefore, causes liquid flow in directions A and B. Clearly, this pumping action is available with no external power source other than the heat applied to vapor chamber 27. Moreover, the waste heat is largely disposed of by the vapor mixing with the pumped liquid and therefore essentially goes directly into heating the pumped liquid. This action is an obvious advantage in a system which already is heating the liquid, and the further advantage is that the pumping action does not require access to electricity which is the energy source typically used to pump liquids.

Figure 3:
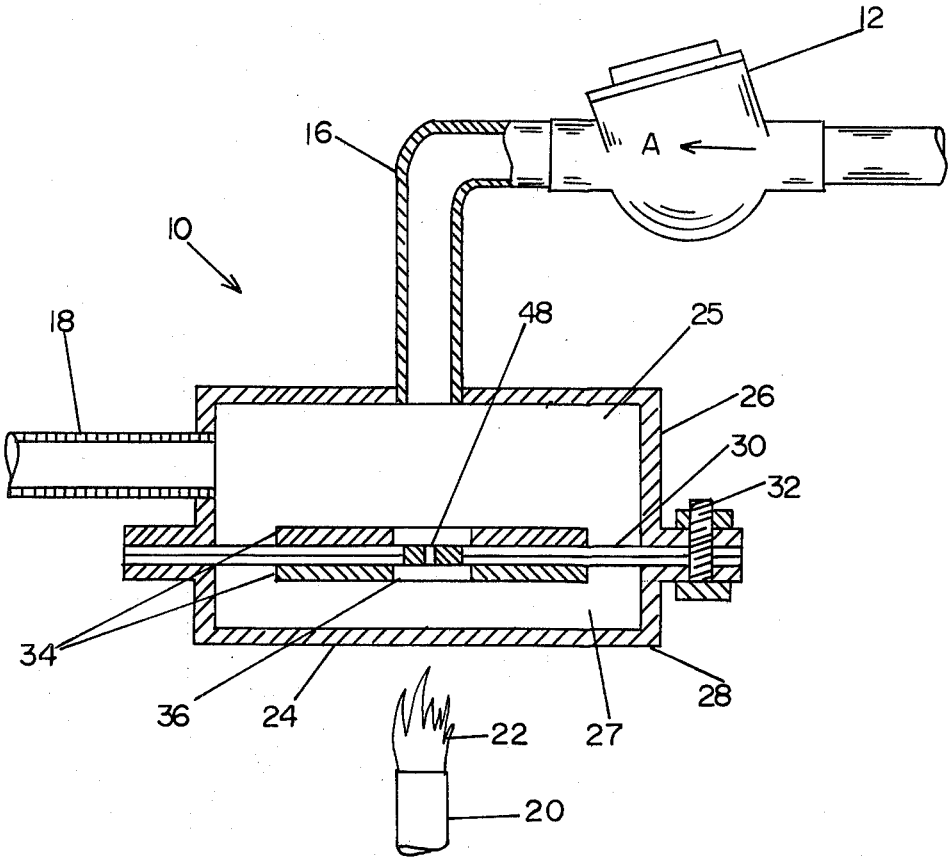
FIG. 3 is a cross section view of an alternate embodiment of the invention.

FIG. 3 shows an alternate embodiment of the invention which is somewhat simpler than the preferred embodiment, but is also less predictable in its operation because the fluid interchange between liquid chamber 25 and vapor chamber 27 is not as specifically controlled. In the alternate embodiment of FIG. 3, neither the spring, the exit check valve or the spindle are included, but orifice 48 is constructed so that its cross sectional area is comparable to the area when the diaphragm of preferred embodiment of FIG. 2 is in its rest position.

Orifice 48 therefore has a fixed effective cross section which functions to permit liquid entry into vapor section 27, vapor pressure buildup to move diaphragm 30 away from wall 24, and vapor venting into liquid chamber 25.

The simple construction of orifice 48 still permits proper operation of pump 10 because the pressure of the liquid head in chamber 25 functions to control the vapor pressure. Before heat is applied this liquid pressure fills chamber 27 with liquid, and, as the vapor pressure builds and first surpasses the liquid head, diaphragm 30 moves away from wall 24. The vapor pressure itself blocks liquid flow into chamber 27. Then, as the vapor pressure in chamber 27 far surpasses the liquid head, diaphragm 30 moves much farther away from wall 24 and ultimately vents the vapor into the liquid in chamber 25. With the vapor pressure released, diaphragm 30 moves back toward wall 25, regardless of the absence of a return spring, because of the natural resiliency of the material of diaphragm 30 and the liquid pressure head.

The embodiment of the invention shown in FIG. 3 therefore functions in much the same manner as the preferred embodiment of FIG. 2, but, because of the fixed cross sectional area and its dependence upon liquid head pressure to regulate the vapor pressure venting, is somewhat less consistent in its characteristics than the preferred embodiment of FIG. 2.

It is to be understood that the form of this invention as shown is merely a preferred embodiment. Various changes may be made in the function and arrangement of parts; equivalent means may be substituted for those illustrated and described; and certain features may be used independently from others without departing from the spirit and the scope of the invention as defined in the following claims. For instance, the orifice and spindle need not be of circular cross section, and both the cross sectional areas and lengths of the various spindle sections may vary depending upon the liquid and the mechanics of motion of the diaphragm. Also, any heat source, such as solar heat or heat transferred from a remote source by heat pipe could be used to power the pump. Moreover, addition of chemical anti-freeze agents such as ethanol with water does not inhibit pump operation.

What is claimed as new and desired to be secured by Letters Patent of the United States is:

1. A liquid pump comprising:
a first chamber including liquid entry and liquid exit means;
a second chamber;
a flexible diaphragm separating the first and second chambers;
at least one unidirectional flow means connected in series with the first chamber in a liquid flow path;
a heat source acting upon the second chamber; and
leak means constructed integral with the flexible diaphragm interconnecting the first and second chambers, including vent means for vapor pressure from the second chamber to flow into the first chamber and liquid supply means for liquid from the first chamber to flow into the second chamber.

2. The liquid pump of claim 1 wherein the leak means includes control means which causes the vent means to operate when the diaphragm is located to reduce the volume of the first chamber.

3. The liquid pump of claim 1 wherein the leak means includes control means which causes the liquid supply means to operate when the vapor pressure in the second chamber has been relieved.

4. The liquid pump of claim 1 wherein the leak means includes control means which minimizes the leakage of vapor pressure from the second chamber as the diaphragm moves in the direction of expanding the volume of the second chamber.

5. A liquid pump comprising:
a first chamber including liquid entry and liquid exit means;
a second chamber;
a flexible diaphragm separating the first and second chambers;
at least one unidirectional flow means connected in series with the first chamber in a liquid flow path;
a heat source acting upon the second chamber; and
leak means interconnecting the first and second chambers, including vent means for vapor pressure from the second chamber to flow into the first chamber and liquid supply means for liquid from the first chamber to flow into the second chamber,
wherein the leak means comprises an orifice constructed integral with the diaphragm and a stationary spindle of varying cross sectional area attached within the pump and oriented within the orifice so that the orifice travels along the spindle as the diaphragm moves.

6. The liquid pump of claim 5 wherein a first section of the spindle is dimensioned to create minimum sliding clearance with the orifice to permit vapor pressure to build up in the second chamber.

7. The liquid pump of claim 5 wherein a second section of the spindle is dimensioned to create sufficient clearance with the orifice to permit venting of the vapor pressure from the second chamber.

8. The liquid pump of claim 5 wherein a third section of the spindle is dimensioned to create a clearance with the orifice which permits limited leakage of liquid from the first chamber into the second chamber when vapor pressure within the second chamber is relieved.

9. The liquid pump of claim 5 wherein the spindle comprises: a first section dimensioned to create minimum sliding clearance with the orifice, and located in the central region of the axial length of the spindle; a second section dimensioned to create a large clearance with the orifice and located in the region of the axial length of the spindle nearest to the first chamber; and a third section dimensioned to create clearance with the office to permit limited liquid leakage and located in the region of the axial length of the spindle nearest to the second chamber.

10. The liquid pump of claim 1 wherein the undirectional flow means comprises a first check valve connected with the liquid entry means of the first chamber.

11. The liquid pump of claim 10 further including a second check valve connected with the liquid exit means of the first chamber.

12. The liquid pump of claim 1 further including a spring to resist movement of the diaphragm toward the first chamber.

* * * * *